United States Patent [19]

Ishida et al.

[11] Patent Number: 4,580,624

[45] Date of Patent: Apr. 8, 1986

[54] LOUVER FIN EVAPORATOR

[75] Inventors: Osamu Ishida, Sano; Tadashi Suzuki, Tochigi; Takumi Ijichi; Toshio Suzuki, both of Sano, all of Japan

[73] Assignee: Nihon Radiator Co., Ltd., Tokyo, Japan

[21] Appl. No.: 554,181

[22] Filed: Nov. 22, 1983

[30] Foreign Application Priority Data

Nov. 25, 1982 [JP] Japan ..... 57-205449

[51] Int. Cl.[4] ..... F28D 1/02

[52] U.S. Cl. ..... 165/152; 165/151

[58] Field of Search ..... 165/151, 152, 153

[56] References Cited

U.S. PATENT DOCUMENTS 3,003,749 10/1961 Morse ..... 165/152

3,993,125 11/1976 Rhodes ..... 165/153

FOREIGN PATENT DOCUMENTS 181368 12/1979 Japan .

*Primary Examiner*—Stephen F. Husar

*Attorney, Agent, or Firm*—Gordon W. Hueschen

[57] ABSTRACT

An evaporator comprising a plurality of heat transfer fins arranged mutually parallelly relative to the direction of air current and a multiplicity of louver boards formed by cuts inserted in substrates of said heat transfer fins perpendicularly to the direction of air current and sloped to prescribed angles from said substrates so as to be divided into a plurality of louver groups by the direction of sloping, which evaporator has the louver at the downstream zone of the fins in the direction of air current sloped so that the flow of the water condensate by gravity directs to the direction of an interior of the evaporator.

6 Claims, 8 Drawing Figures

LOUVER FIN EVAPORATOR

BACKGROUND OF THE INVENTION

1. Field of the Invention

This invention relates to an evaporator for use in an air conditioner system. More particularly, this invention relates to a so-called louver fin type evaporator.

2. Description of Prior Art

Generally, a louver fin type evaporator 1 which is used in an automotive air conditioner system has its core part formed, as illustrated in FIG. 1, by using corrugated fins as its heat transfer fins 2, zigzagging a profile tube 3 in such a manner that straight portions thereof run parallelly to one another, and soldering the aforementioned corrugated fins 2 to the opposed outer surfaces of the parallel straight portions of the profile tube 3. The opposite ends of the profile tube 3 are connected to a coolant inlet tube 4 and a coolant outlet tube 5 respectively.

The heat transfer fins 2 of this evaporator 1 are formed by cutting a multiplicity of slats (louver boards R) in a substrate 6 and bending the cut slats in such a manner that, as viewed in a cross section cut in the direction of air current (namely, in the direction perpendicular to the surface of this sheet with respect to the diagram of FIG. 1), a first louver group $R_1$ is sloped downwardly, a second louver group $R_2$ upwardly, a third louver group $R_3$ downwardly, and so on respectively relative to the direction of air current as illustrated in FIG. 2 (U.S. Pat. Nos. 3,993,125 and 3,003,749, Japanese Patent Open No. SHO 50(1975)-74245, Japanese Patent Publication No. SHO 52 (1977)-27852, and Japanese Utility Model Open Nos. SHO 52 (1977)-59995 and SHO 54(1979)-181,368.

The question as to how such louver boards R constituting the corrugated fins should be sloped relative to the direction of air current to make the most of the performance of the heat exchanger has been studied very little to date. Even in the assemblage of the aforementioned evaporator 1, the corrugated fins as a whole are completed by simply inserting numerous pieces between the opposed outer surfaces of the parallel straight portion of the profile tube 3. While these louver boards R are so set up during the assemblage, no due attention is paid to exactly regulating the directions in which the louver groups are to be sloped.

Only because this evaporator 1 is destined to give rise to water condensate, the behavior of water drops resulting from the condensation has been analyzed dynamically with a view to developing a measure to prevent such water drops from being blown away by the air current (Japanese Utility Model Open No. SHO 54(1979)-181368).

The outcome of this dynamic analysis is an invention which relates to downwardly sloping, relative to the direction of air current, the most downstream louver group $R_3$ which is most liable to seize water condensate between adjacent louver boards R. In this particular region, the forced fall of water condensate by the air current and the spontaneous fall of water condensate by the gravitational attraction offset enough for water drops to fall down smoothly.

The measure to preclude possible drift of water condensate in the air current within the evaporator, however, cannot be devised successfully by mere dynamic analysis of the external forces exerted on water drops. The water condensate, on exposure to the air current, is caused to flow along louver boards or even heat transfer fins. The portion in which the water condensate occurs and stagnates is a kind of tunnel enclosed on all sides with walls. Due consideration paid exclusively to gravitational attraction and expelling force of air current cannot be sufficient for thorough elucidation of the behavior of water drops in question.

OBJECT OF THE INVENTION

An object of this invention, therefore, is to provide an improved evaporator.

Another object of this invention is to provide an evaporator for an air conditioner system, which evaporator renders difficult the occurrence of the phenomenon of drift of water condensate by the air current.

SUMMARY OF THE INVENTION

The objects described above are accomplished by this invention providing an evaporator comprising a plurality of heat transfer fins arranged mutually parallelly relative to the direction of air current and a multiplicity of louver boards formed by cuts inserted in substrates of the aforementioned heat transfer fins perpendicularly to the direction of air current and sloped to prescribed angles from the aforementioned substrates so as to be divided into a plurality of louver groups by the direction of sloping, which evaporator has the louver at the downstream zone of the fins in the direction of air current sloped so that the flow of the water condensate by gravity directs to the direction of an interior of the evaporator.

This invention has been perfectd with a view to overcoming the drawbacks suffered by the conventional evaporator. To be specific, in due consideration of the fact that when an air current occurs in a tunnel, the velocity of the air current in the peripheral portion bordering on the wall of the tunnel is nominal as compared with the velocity in the central portion of the cavity of the tunnel and the fact that water condensate is not allowed to adhere fast to the heat transfer fins but is caused to flow along the heat transter fins by the force of air current, the present invention contemplates having the louver at the downstream zone of the fins in the direction of air current sloped so that the flow of the water condensate by gravity directs to the direction of an interior of the evaporator and, thus, preventing water condensate from being readily drifted away in the air current.

PREFERRED EMBODIMENT OF THE INVENTION

Now, the present invention will be described below with reference to one working example of this invention with reference to the accompanying drawings.

Figure 1:
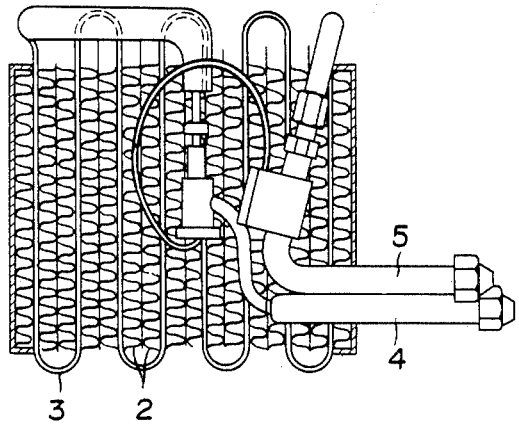
FIG. 1 PRIOR ART
FIG. 1 is a front view of a conventional evaporator.
Figure 2:
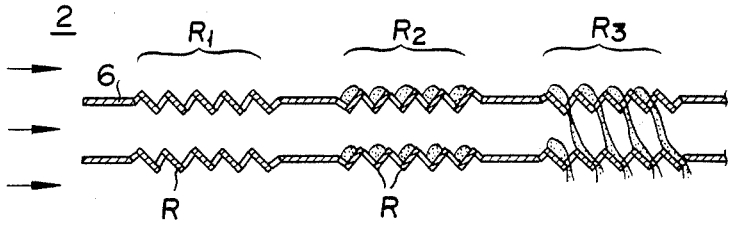
FIG. 2 PRIOR ART
FIG. 2 is a longitudinal cross section illustrating one example of a conventional louver fin.
Figure 3:
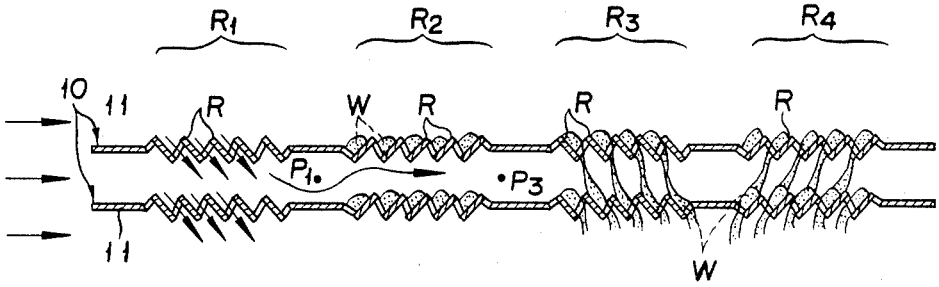
FIG. 3 is a longitudinal cross section illustrating one example of a louver fin according to the present invention.

FIG. 3 illustrates one embodiment of the heat transfer fin which is provided for the evaporator of the present invention. Such heat transfer fins 10 are mutually parallelly disposed. In each of the substrates 11 of the heat transfer fins 10, four louver groups $R_1$–$R_4$ are cut and raised.

Figure 6:
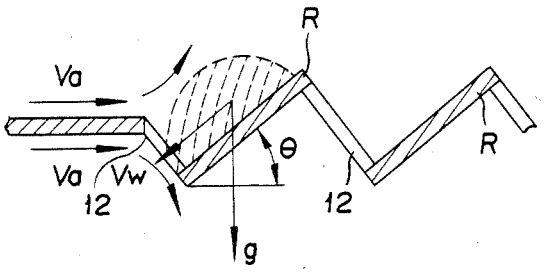
FIG. 6 is an enlarged cross section of an essential part of a fourth louver group in the diagram of FIG. 3.

The individual louver boards R in each of the louver groups are sloped in one fixed direction. Experimentally, the angle $\theta$ of this slope in the louver boards R (see FIG. 6) is desired to fall in the range of about 25° to 35°, particularly near 30°.

The louver boards in the first louver group $R_1$ are sloped downwardly relative to the direction of air current, those in the second louver group $R_2$ sloped upwardly relative to the same direction, and those of the third louver group $R_3$ (namely, the louver group situated one step upstream from the most downstream louver group) are sloped downwardly relative to the same direction, and those of the last and fourth louver group $R_4$ are sloped upwardly relative to the same direction.

Particularly, the present invention is characterized by having the louver group at the downstream zone of the fins so that the flow of the water condensate by gravity directs to the direction of an interior of the evaporator, and having the louver boards of the most downstream louver group $R_4$ sloped upwardly relative to the direction of air current. To be more specific, the drift of water from the evaporator is nothing else but the release of the water which is retained by the heat transfer fins 10 and the louver boards R. No drift of water can occur where this water is retained stably. Thus, it is safely concluded that desired preclusion of the drift of water ought to be accomplished by increasing the ability of the most downstream louver group $R_4$ to retain the water condensate.

Figure 4:
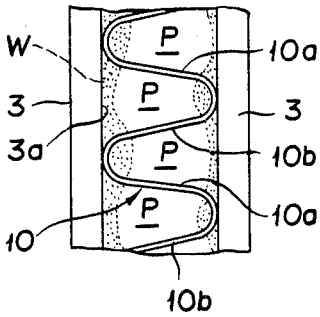
FIG. 4 is a front view of an essential part of a heat transfer fin.
Figure 5:
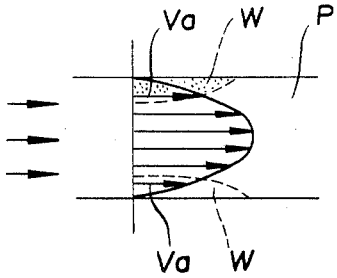
FIG. 5 is a model diagram illustrating distribution of air velocity.

The water condensate W adheres to the heat transfer fins 10 or the profile tube 3 as illustrated in FIG. 4. This water condensate W is caused to flow inside a closed space P (the portion defined by the flat plates 10*a*, 10*b* of the heat transfer fins 10 and the lateral walls 3*a* of the profile tube 3 as illustrated in FIG. 4) when it is forced out by the air current which has an air velocity distribution as illustrated in FIG. 5. As is clear from FIG. 5, however, the water condensate is urged exclusively by air current of a small velocity Va. The portion of water condensate which stagnates between the louver boards R slopes upwardly relative to the air current and the holes 12 formed in raising the louver boards R from the substrate is not affected by the air current of this velocity Va to an extent of being drifted away. Instead, it is caused to flow over the louver boards R by the force Vw under the influence of the gravitational attraction g. In other words, the direction of the flow of this water condensate is toward the inner side of the evaporator, quite contrary to that observed in the conventional evaporator. This fact means that the evaporator of this invention does not release any water outside its enclosure. It is safely concluded that the most downstream louver group $R_4$ serves to deviate the flow of the water condensate toward the water condensate from being drifted out of the enclosure of the evaporator. This situation is depicted in FIG. 3. The direction of the flow of water in the fourth louver group $R_4$ and that in the third louver group $R_3$ are different because their louver boards R are sloped in opposite directions. Consequently, while the water condensate flows down from the upper heat transfer fins 10 to the lower ones, the louver boards R in such heat transfer fins deflect the courses of water flow.

The following experiment was conducted for the purpose of demonstrating the function of the most downstream louver group with respect to the behavior of water condensate in the evaporator:

(A) When the louver boards in the most downstream louver group were sloped downwardly relative to the direction of air current—One heat transfer fin containing louver boards sloped as described above was erected upright. A fixed amount of water was allowed to flow down the heat transfer fin and a current of air was passed therethrough (at a rate of 0.3 to 0.4 $m^3$/min). The flow of water was observed to be deflected toward the direction of air current.

(B) When the louver boards in the most downstream louver group were sloped upwardly relative to the direction of air current—The procedure of (A) was repeated, except that the louver boards were sloped in the opposite direction. The water was observed to flow down substantially straight through the holes remaining after the fabrication of louver boards.

Figure 7:
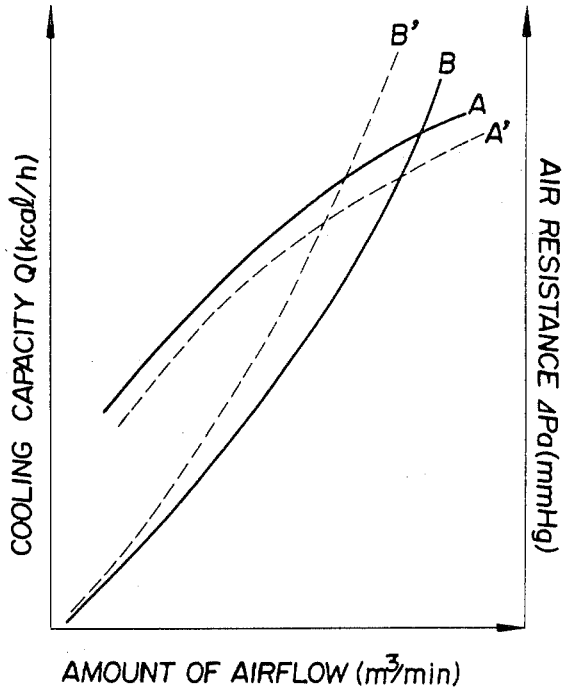
FIG. 7 is a graph comparing the properties of a conventional louver fin and those of the louver fin of this invention.

When the most downstream louver group $R_4$ is sloped upwardly relative to the direction of air current as described above, it provides effective prevention of the drift of water condensate by the air current. Further in terms of air cooling property and alleviation of air resistance, better results are obtained when the most downstream louver group is thus sloped upwardly than when it is sloped downwardly relative to the direction of air current. The air cooling property exhibited when the louver group is sloped upwardly excels that exhibited when the louver group is sloped downwardly relative to the direction of air current. The air cooling property exhibited when the louver group is sloped downwardly is evident from comparison of the solid line A representing the former's air cooling property and the dotted line A' representing the latter's in FIG. 7. The air resistance offered to the louver group sloped upwardly is lower than that offered to the louver group sloped downwardly as is evident from comparison of the solid line B representing the former's and the dotted line B' representing the latter's. The reason for the better results enjoyed by the most downstream louver group sloped upwardly is that if, in the heat transfer fins in which the successive louver groups are alternately sloped upwardly and downwardly, the most downstream louver group $R_4$ is sloped upwardly, then the louver group $R_3$ situated one step upstream is naturally sloped downwardly and this third louver group $R_3$ causes early fall of water condensate to lower air resistance and improves the air cooling property. The water condensate occurs especially in the first one third or so of the entire length of the heat transfer fins in the direction of air current and it collects most heavily in the last one fourth of the entire length similarly in the direction of air current. When four louver groups $R_1$–$R_4$ are formed in the heat transfer fins, the water condensate collects predominantly in the louver group that falls in the region directly above the most downstream side. When the louver boards in the third louver group $R_3$ are sloped downwardly, therefore, the dispersion of water from the fins is attained with high efficiency owing to the combination of the force of air current and the gravitational attraction.

Figure 8:
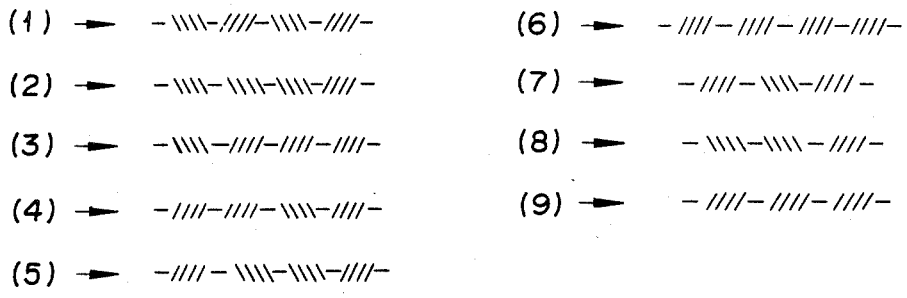
FIG. 8 is a schematic longitudinal cross section illustrating other embodiments of the present invention.

The embodiment so far described constitutes just one of numerous possible working examples of this invention. Insofar as the most downstream louver group is sloped upwardly, it does not matter whether the first through third louver groups $R_1$–$R_3$ are sloped in either directions. Various combinations of sloping directions of such louver groups are conceivable as illustrated in FIG. 8 (1)–(9), for example.

Only, better results are obtained as described above when the fourth louver group $R_4$ is sloped upwardly, and the third louver group downwardly.

Further, the present invention is not limited to the evaporator having the fins in which the group of the louver is formed, but any of the fins having the louver at the downstream zone of the fins in the direction of air current sloped so that the flow of the water condensate by gravity directs to the direction of the interior of the evaporator can be used.

As is clear from the foregoing description, this invention provides an evaporator capable of effectively preventing water condensate from being drifted on air current by having the louver at the downstream zone of the fins in the direction of air current so that the flow of the water condensate by gravity directs to the direction of an interior of the evaporator. When the louver one step upstream is sloped downwardly, the water condensate which occurs on the individual louver boards is effectively prevented from stagnating between the adjacent louver boards, interfering with the air current, increasing air resistance, decreasing the contact area between air and the fins, lowering the air cooling property, complicating the construction of the evaporator as compared with the conventional countertype, and increasing the cost. The combination of these two most downstream louver groups which are sloped as described above results in improving the air cooling property further and notably detracting from air resistance and permits the accessorial components, especially the air blower and other similar items, to be miniaturized. Thus, the present invention is highly advantageous.

What is claimed is:

1. An evaporator comprising a plurality of heat transfer fins arranged mutually parallelly relative to the direction of air current and a multiplicity of louver boards formed by cuts inserted in substrates of said heat transfer fins perpendicularly to the direction of air current and sloped to prescribed angles from said substrates so as to be divided into a plurality of louver groups by the direction of sloping, said evaporator being subject to water condensation on said louvers and having the louvers in the most downstream group sloping upwardly at an angle of about 25 degrees to about 35 degrees in the direction of the flow of air, so that the flow of water condensate is directed by gravity in the direction of the interior of the evaporator.

2. An evaporator according to claim 1, wherein said heat transfer fins have the louvers in the louver group one step upstream from said most downstream louver group sloped downwardly relative to the direction of air flow.

3. An evaporator according to claim 1, wherein louver groups intermediate between the most upstream louver group and the most downstream louver group are sloped alternately downwardly and upwardly.

4. An evaporator according to claim 1, wherein the louvers in said most downstream louver group slope upwardly at an angle of about 30 degrees relative to the substrates.

5. An evaporator according to claim 1, wherein louver groups intermediate between the most upstream louver group and the most downstream louver group are sloped alternately downwardly and upwardly.

6. An evaporator according to claim 2, wherein louver groups intermediate between the most upstream louver group and the most downstream louver group are sloped alternately downwardly and upwardly.

* * * * *

UNITED STATES PATENT AND TRADEMARK OFFICE

CERTIFICATE OF CORRECTION

PATENT NO. : 4,580,624

DATED : April 8, 1986

INVENTOR(S) : Osamu Ishida, et al

It is certified that error appears in the above-identified patent and that said Letters Patent is hereby corrected as shown below:

Column 2, line 33, "perfectd" should read -- perfected --.

Column 2, line 42, "transter" should read -- transfer --.

Column 5, line 12, delete the comma "," after "upwardly"

Signed and Sealed this

*Sixteenth* Day of *September 1986*

[SEAL]

*Attest:*

DONALD J. QUIGG

*Attesting Officer*

*Commissioner of Patents and Trademarks*